US007563344B2

(12) United States Patent
Beuther et al.

(10) Patent No.: US 7,563,344 B2
(45) Date of Patent: Jul. 21, 2009

(54) MOLDED WET-PRESSED TISSUE

(75) Inventors: Paul Douglas Beuther, Neenah, WI (US); Cristina Asensio Mullally, Neenah, WI (US); Jeffrey Dean Holz, Sherwood, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 399 days.

(21) Appl. No.: 11/588,652

(22) Filed: Oct. 27, 2006

(65) Prior Publication Data

US 2008/0099169 A1 May 1, 2008

(51) Int. Cl.
*D21H 13/00* (2006.01)

(52) U.S. Cl. ..... 162/111; 162/117; 162/109; 162/125; 162/129

(58) Field of Classification Search ..... 162/111, 162/117, 109, 125, 129
See application file for complete search history.

(56) References Cited

U.S. PATENT DOCUMENTS

| | | | |
|---|---|---|---|
| 4,551,199 | A | 11/1985 | Weldon |
| 4,834,838 | A | 5/1989 | Klowak |
| 4,849,054 | A | 7/1989 | Klowak |
| 5,298,124 | A | 3/1994 | Eklund et al. |
| 5,411,636 | A | 5/1995 | Hermans et al. |
| 5,429,686 | A | 7/1995 | Chiu et al. |
| 5,672,248 | A | 9/1997 | Wendt et al. |
| 5,832,962 | A | 11/1998 | Kaufman et al. |
| 6,039,838 | A | 3/2000 | Kaufman et al. |
| 6,287,426 | B1 | 9/2001 | Edwards et al. |
| 6,582,560 | B2 | 6/2003 | Runge et al. |
| 6,998,024 | B2 | 2/2006 | Burazin et al. |
| 2004/0238135 | A1 | 12/2004 | Edwards |
| 2005/0098293 | A1 | 5/2005 | Inoue et al. |
| 2005/0126728 | A1 | 6/2005 | Beuther et al. |
| 2005/0217814 | A1 | 10/2005 | Super |
| 2005/0236122 | A1 | 10/2005 | Mullally et al. |
| 2005/0241786 | A1 | 11/2005 | Edwards |
| 2005/0241787 | A1 | 11/2005 | Murray |
| 2006/0130985 | A1 | 6/2006 | Beuther et al. |
| 2006/0237154 | A1 | 10/2006 | Edwards et al. |
| 2006/0243408 | A1 | 11/2006 | Blodgett et al. |
| 2008/0099169 | A1 | 5/2008 | Beuther et al. |

OTHER PUBLICATIONS

TAPPI Standard Practice T 402 sp-03, "Standard Conditioning and Testing Atmosphere For Paper, Board, Pulp Handsheets, and Related Products," published by the TAPPI Press, Atlanta, Georgia, revised 2003, pp. 1-5.

"Mountains® Technology," Internet web page "http://www.digitalsurf.fr/en/oemmnt.htm", Digital Surf, France, viewed and printed prior to the filing date of the current application, pp. 1-2, Jan. 1998.

TAPPI Official Test Method T 402 om-93, "Standard Conditioning and Testing Atmospheres For Paper, Board, Pulp Handsheets, and Related Products," published by the TAPPI Press, Atlanta, Georgia, revised 1993, pp. 1-3.

TAPPI Official Test Method T 411 om-89, "Thickness (Caliper) of Paper, Paperboard, and Combined Board," published by the TAPPI Press, Atlanta, Georgia, revised 1989, pp. 1-3.

*Primary Examiner*—Mark Halpern
(74) *Attorney, Agent, or Firm*—Gregory E. Croft

(57) ABSTRACT

Wet-pressed creped tissue sheets exhibit continuous undulating valleys separated by continuous mono-planar macro-ridges running in the machine direction of the sheet, the macro-ridges being of a lower fiber density relative to the fiber density of the undulating valleys. The tissue structure can be created by pressing a densified tissue web against the surface of a Yankee dryer while the web is supported by a texturizing (molding) fabric having a web-supporting surface having highly topographic continuous or substantially continuous ridges and valleys and thereafter creping the web.

19 Claims, 14 Drawing Sheets

MOLDED WET-PRESSED TISSUE

BACKGROUND OF THE INVENTION

Many attempts to combine the bulk-generating benefit of throughdrying with the dewatering efficiency of wet-pressing have been disclosed over the past 20 years, but instead of delivering the best of both technologies, what often resulted were processes that fell short of their goal, not only regarding the rate of production and the energy costs for dewatering, but also regarding product characteristics. An example of a promising process is disclosed in U.S. Pat. No. 6,287,426 issued Sep. 11, 2001 to Edwards et al., which is herein incorporated by reference. This process utilizes a high pressure dewatering nip formed between a felt and a smooth impermeable belt to increase the wet web consistency to about 35 to 48 percent. The dewatered web is then transferred to a "web-structuring" woven fabric with the aid of a vacuum roll to impart texture to the web prior to drying. While the process of Edwards et al. is effective for relatively high basis weight webs, it is not well suited for processing light weight tissue webs at high speeds desirable for commercial applications because of the difficulty associated with transferring low basis weight wet webs, which have virtually no strength, from the smooth belt to the web-structuring fabric. In addition, it has been found that the web-structuring fabrics disclosed for use in such a process result in a tissue that is gritty feeling with insufficient softness.

Therefore there is a need for an improved soft, high bulk, lightweight wet-pressed tissue.

SUMMARY OF THE INVENTION

It has now been discovered that a unique wet-pressed tissue sheets can be made using the process of Edwards et al., for example, by using special texturizing fabrics. The resulting tissue sheet can be made at high speeds and exhibits nearly all of the bulk and softness of a throughdried product while also being aesthetically pleasing. The tissue sheets are characterized by widely spaced apart continuous "ridges of softness" that are imparted to the sheets by the texturizing fabric design. When the special texturizing fabrics are used in combination with other process modifications, such as the use of certain types of impermeable belts in combination with other processing conditions as described herein, tissue sheets of this invention having a low basis weight can be made at relatively high speeds. However, the tissue sheets of this invention having a low basis weight can also be made using the unmodified process of Edwards et al, albeit at lower speeds.

Hence in one aspect, the invention resides in a creped, wet-pressed tissue sheet of papermaking fibers having a machine direction and a cross-machine direction, said tissue sheet having continuous undulating valleys separated by continuous mono-planar macro-ridges (ridges of softness) running in the machine direction of the sheet, the macro-ridges being of a lower fiber density relative to the fiber density of the undulating valleys.

In another aspect, the invention resides in a creped, wet-pressed tissue sheet of papermaking fibers having a machine direction and a cross-machine direction, said tissue sheet having continuous undulating valleys of mini-ridges separated by continuous mono-planar macro-ridges running in the machine direction of the sheet, wherein the ratio of the average thickness of the macro-ridges to the average thickness of the mini-ridges is about 1.5 or greater. For purposes herein, the "thickness" is the shortest distance from one side of the structure in question to the other. In this aspect, advantageously, the fiber density of the mono-planar ridges can be lower than the fiber density of the undulating valleys.

The alternating macro-ridges and valleys of the tissue sheets of this invention are imparted to the sheet by the three-dimensional surface contour of the texturizing fabric. During processing, the tissue sheet is densified uniformly by an upstream wet-pressing water removal step, after which the sheet is molded during transfer onto the topographical texturizing fabric, thereby creating the precursors to the final macro-ridges and valleys. The macro-ridges, which protrude from the side of the sheet that does not contact the texturizing fabric, become further densified as the sheet, supported by the texturizing fabric, is pressed against the surface of the dryer and adhered to the dryer surface. Because the valleys in the sheet are recessed relative to the ridges, they are further densified to a lesser degree, if at all, when the sheet is pressed against the dryer surface. Thereafter, when the web is creped, "mini-ridges" having crests running in the cross-machine direction of the sheet are created within the valleys. These mini-ridges create undulations in the machine direction of the sheet and bridge the distance between adjacent machine direction macro-ridges. The machine direction macro-ridges, which are strongly adhered to the surface of the dryer, are more affected by creping. As a consequence, the macro-ridge regions become more highly debonded, thicker and less dense than the valley regions. Because the adhesion to the dryer is substantially continuous along the macro-ridge regions, the creping (debonding) is relatively uniform and the sheet surface topography within the ridges remains substantially mono-planar when viewed in cross-section. The dimensions of the various structural features of the tissue sheets of this invention can readily be measured using scaled photographs, such as those shown herein, or by surface profilometry, which is well known in the art. Because the variations in basis weight are minimal throughout the sheets when they are formed, the thickness of the various sheet structures is proportional to the fiber density.

This structure is different from traditional through-air-dried tissue, where the regions away from the dryer surface are not compressively densified and are thus of a similar or even lower density than the region of tissue next to the dryer.

As used herein, unless otherwise specified, the term "running in the machine direction" of the sheet means that the macro-ridges and valleys can be oriented at an angle of from 0 to about ±30 degrees relative to the true machine direction (0 degrees) of the sheet. The macro-ridges are substantially continuous and not discrete. Accordingly, the alignment or orientation of the macro-ridges and valleys relative to the machine direction of the sheet can be from 0 to about ±30 degrees, more specifically from 0 to about ±15 degrees, more specifically from 0 to about ±10 degrees, more specifically from about 0 to about ±5 degrees and still more specifically the alignment can be parallel to the machine direction (0 degrees). Furthermore, the alignment or orientation relative to the machine direction can be from about ±5 to about ±15 degrees and still more specifically from about ±10 to about ±15 degrees. The ridges can be straight or wavy to improve the aesthetic appearance of the tissue sheet. For wavy or otherwise back-and-forth angled ridges, the alignment of the ridge is determined as an overall average direction.

The ratio of the average thickness of the macro-ridges to the average thickness of the mini-ridges within the valley regions can be about 1.5 or greater, more specifically from about 1.5 to about 6, more specifically from about 1.5 to about 5, more specifically from about 1.5 to about 4, more specifically from about 1.5 to about 3, and still more specifically from about 2 to about 3.

The width of the machine direction macro-ridges can be less than the width of the valleys in order to provide aesthetics to the tissue structure. The width of the machine direction macro-ridges can also be greater than the width of the valleys in order to improve drying efficiency and provide larger ridges of softness. More specifically, the width of the macro-ridges can be from about 0.5 to about 1.5 millimeters, more specifically from about 0.75 to about 1.25 millimeters, and still more specifically about 1 millimeter. The cross-machine direction spacing of the macro-ridges, as measured peak-to-peak, can be from about 0.5 to about 4 millimeters, more specifically from about 1 to about 3.5 millimeters, and still more specifically from about 1.5 to about 2.5 millimeters.

The width of the valleys, as measured in the cross-machine direction of the sheet, can be from about 0.5 to about 2.5 millimeters, more specifically from about 0.5 to about 2 millimeters, and still more specifically from about 1 to about 2 millimeters.

The size and spacing of the mini-ridges will depend upon a combination of the texturizing fabric design and creping conditions. In general, the machine direction spacing of the mini-ridges, as measured peak-to-peak, can be from about 0.2 to about 1 millimeter, more specifically from about 0.3 to about 0.8 millimeter, and still more specifically from about 0.4 to about 0.6 millimeter. The height of the mini-ridges, as measured from the bottom of the valley to the peak of the mini-ridge, can be from about 0.05 to about 0.5 millimeter, more specifically from about 0.1 to about 0.4 millimeter, and still more specifically from about 0.1 to about 0.3 millimeter.

The finished basis weight of the tissue sheets of this invention can be about 40 grams or less per square meter, more specifically from about 10 to about 40 grams per square meter (gsm), more specifically from about 10 to about 30 gsm and still more specifically from about 15 to about 20 gsm. The fibers which make up the tissue sheets can be any papermaking fiber known in the art, particularly cellulose fibers, such as hardwood and softwood fibers.

The "bulk" of the tissue sheets of this invention can be about 10 cubic centimeters or greater per gram of fiber, more specifically from about 10 to about 20 cubic centimeters per gram of fiber (cc/g). As used herein, a "tissue sheet" is a single ply of tissue, as opposed to a multi-ply product.

Test Methods

As used herein, "bulk" is calculated as the quotient of the overall sheet caliper under load (hereinafter defined) of a tissue sheet, expressed in microns, divided by the dry basis weight, expressed in grams per square meter. The resulting sheet bulk is expressed in cubic centimeters per gram. More specifically, the tissue overall sheet caliper is the representative thickness of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the "machine direction (MD) tensile strength" is the peak load per 3 inches of sample width when a sample is pulled to rupture in the machine direction. Similarly, the "cross-machine direction (CD) tensile strength" is the peak load per 3 inches of sample width when a sample is pulled to rupture in the cross-machine direction. The percent elongation of the sample prior to breaking is the "stretch".

The procedure for measuring tensile strength and stretch is as follows. Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11 S, Serial No. 6233. The data acquisition software is MTS TestWorks® for Windows Ver. 3.10 (MTS Systems Corp., Research Triangle Park, NC). The load cell is selected from either a 50 Newton or 100 Newton maximum, depending on the strength of the sample being tested, such that the majority of peak load values fall between 10-90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

The method used to prepare the microphotographs of the tissue thickness profiles in FIGS. 5 and 6 below is as follows. A small sample of tissue of roughly 2-3 square centimeters is placed on a piece of card stock on a metal anvil that sits in a pool of liquid nitrogen inside an insulated open container. The tissue is cut with a never-used razor blade that has been first cleaned with alcohol. The alignment of the cut is slightly askew of the true machine direction of the sample so that different regions along the cut will show the different density regions of the tissue structure without making multiple samples. The cut is made by holding the razor blade over the tissue with pliers or forceps and striking the back of the razor blade with a small mallet against the tissue and the supporting metal anvil. This method will cut the chilled tissue cleanly without deforming the shape of the tissue structure. Multiple cuts can be made parallel to the first cut with a new razor blade in order to obtain a tissue sample approximately 5 millimeters wide. Each sample is then removed from the anvil and mounted on card stock with Yankee-side up with double sided tape such that about 1 millimeter of tissue extends past the edge of the card stock and tape. The sample is placed under an optical microscope with the cut edge facing toward the lens. The image is illuminated and magnified to a level suitable for viewing.

The non-contacting surface profilometry method used to create the three-dimensional representation of the dryer-contacting side of the tissue in FIGS. 2 and 7 herein is described in published U.S. Patent Application US2005/0236122 A1 to Mullally et al, herein incorporated by reference. More particularly, the three-dimensional optical surface topography maps can be determined using a MicroProf™ measuring system equipped with a CHR 150 N optical distance measurement sensor with 10 nm z-direction resolution (system available from Fries Research and Technology GmbH, Gladbach, Germany). The MicroProf measures z-direction distances by utilizing chromatic aberration of optical lenses to analyze focused white light reflected from the sample surface. Samples are mounted with a spray-adhesive onto a glass slide. An x-y table is used to move the sample in the machine direction (MD) and cross-machine direction (CD). MD and CD resolution was set at 20 um.

The three-dimensional surface profilometry maps can be exported from MicroProf in a unified data file format for analysis with surface topography software TalyMap Universal (ver 3.1.10, available from Taylor-Hobson Precision Ltd., Leicester, England). The software utilizes the Mountains® technology metrology software platform (www.digitalsurf.fr) to allow a user to import various profiles and then execute different operators (mathematical transformations) or studies (graphical representations or numeric calculations) on the profiles and present them in a format suitable for desktop publishing.

Within the TalyMap software, operators utilized for this work include thresholding, which is an artificial truncation of the profile at a given altitudes, and filtering. Thresholding cleans up the image, removing individual fibers or surface dust and adjusts the ranges of the depths recorded. A Gaussian filter with a 0.2 mm cut-off is applied to further smooth the surface, averaging across 10 data points, and remove individual fibers by removal of local roughness. This yields the "surface profilometry" profile shown in FIG. 7. A section of the profile is then zoomed and a continuous axonometric study performed. This creates a continuous representation of the surface in three-dimensions with simulated light reflection. Displaying the result with a pseudo-photo rendering yields an image as shown in FIG. 2.

In the interests of brevity and conciseness, any ranges of values set forth in this specification are to be construed as written description support for claims reciting any sub-ranges having endpoints which are whole number (or like number) values within the specified range in question. By way of a hypothetical illustrative example, a disclosure in this specification of a range of from 1 to 5 shall be considered to support claims to any of the following sub-ranges: 1-4; 1-3; 1-2; 2-5; 24; 2-3; 3-5; 3-4; and 4-5. Similarly, a disclosure in this specification of a range of from 0.1 to 0.5 shall be considered to support claims to any of the following sub-ranges: 0.1-0.4; 0.1-0.3; 0.1-0.2; 0.2-0.5; 0.2-0.4; 0.2-0.3; 0.3-0.5; 0.3-0.4; and 0.4-0.5.

BRIEF DESCRIPTION OF THE DRAWING

FIG. 9 is the same fabric partially shown in FIG. 3.

DETAILED DESCRIPTION OF THE DRAWING

The invention will now be further described with reference to the drawings. Unless otherwise stated, like reference numbers in the various figures represent like features.

Figure 1:
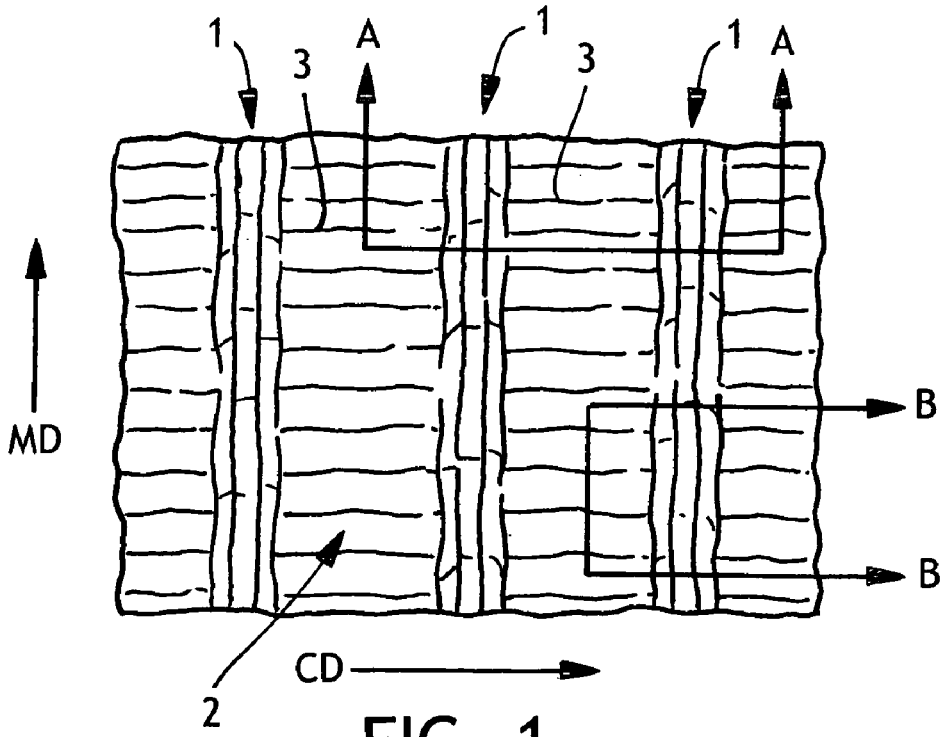
FIG. 1 is a schematic plan view of a tissue sheet in accordance with this invention.

Referring to FIG. 1, shown is a schematic plan view of a tissue sheet in accordance with this invention, showing the side of the tissue sheet that contacts the dryer surface during creping. Shown are the machine direction (MD) and cross-machine direction (CD) of the sheet. Also shown are the mono-planar macro-ridges 1 running in the machine direction of the sheet. Also shown are the undulating valleys 2 and the peaks of the mini-ridges 3 within the valleys that are generated during creping.

Figure 1A:
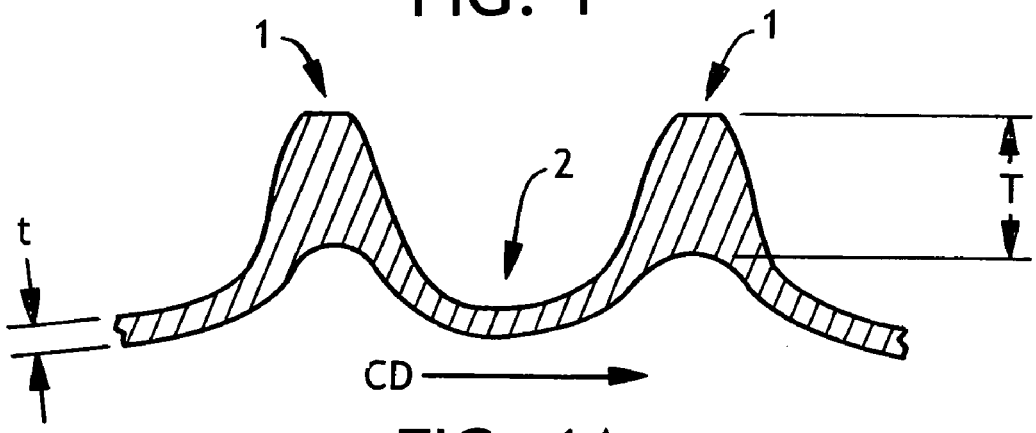
FIG. 1A is a cross-section, taken in the machine direction, of the tissue sheet of FIG. 2.

FIG. 1A is a schematic cross-section of the tissue sheet of FIG. 1, taken along line A-A of FIG. 1. Shown are cross-sections of the macro-ridges, illustrating the relative thickness "T" of the macro-ridges compared to the thickness "t" of the mini-ridges within the valleys.

Figure 1B:
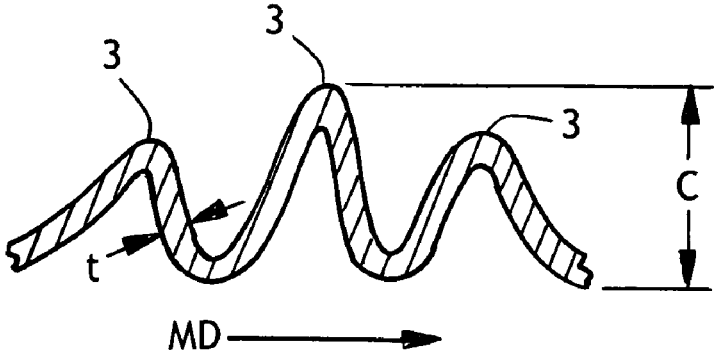
FIG. 1B is a cross-section, taken in the cross-machine direction, of the tissue sheet of FIG. 1.

FIG. 1B is a schematic cross-section of the tissue sheet of FIG. 1, taken along line B-B of FIG. 1, further illustrating the relative thickness of the macro-ridges compared to the thickness of the mini-ridges. Also shown is the no-load caliper "C", illustrating the conceptual difference between caliper and thickness.

Figure 2:
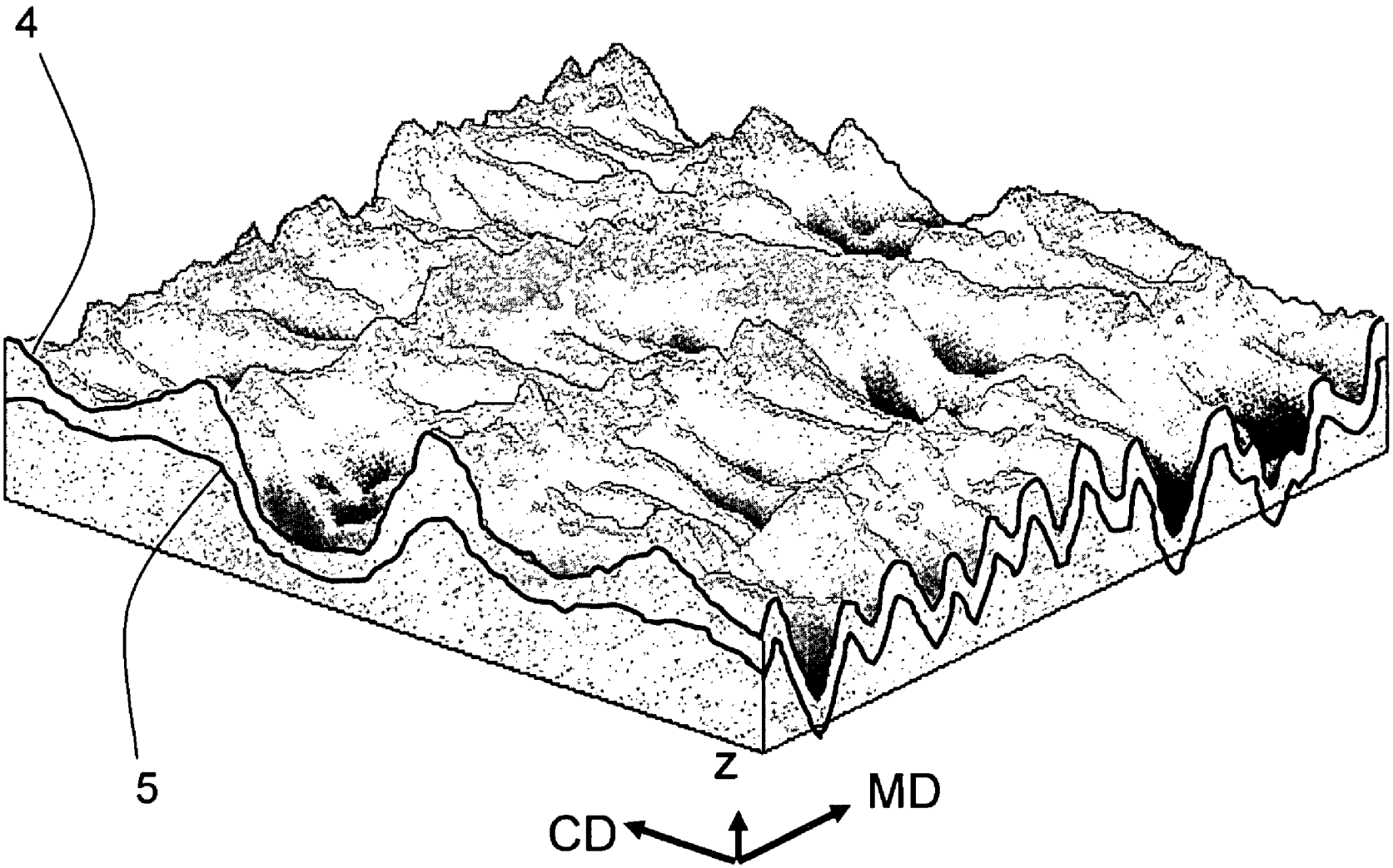
FIG. 2 is a more realistic three-dimensional representation, obtained by surface profilometry, of the dryer-contacting side of a tissue sheet of this invention, similar to that illustrated in FIG. 1.

FIG. 2 is a three-dimensional representation, obtained by surface profilometry, of the dryer-contacting side of a tissue sheet of this invention, similar to that illustrated in FIG. 1. The surface boundary of the Yankee-contacting side of the sheet is highlighted by reference number 4. The surface boundary of the fabric side (non-Yankee side) of the sheet is designated by reference number 5 and is schematically drawn along each axis to further illustrate the differences in thickness (and density) between the macro-ridge regions of the sheet and the mini-ridges within the valley regions. The tissue was made according to the method described in Example 1 herein using the texturizing fabric of FIG. 9.

Figure 3:
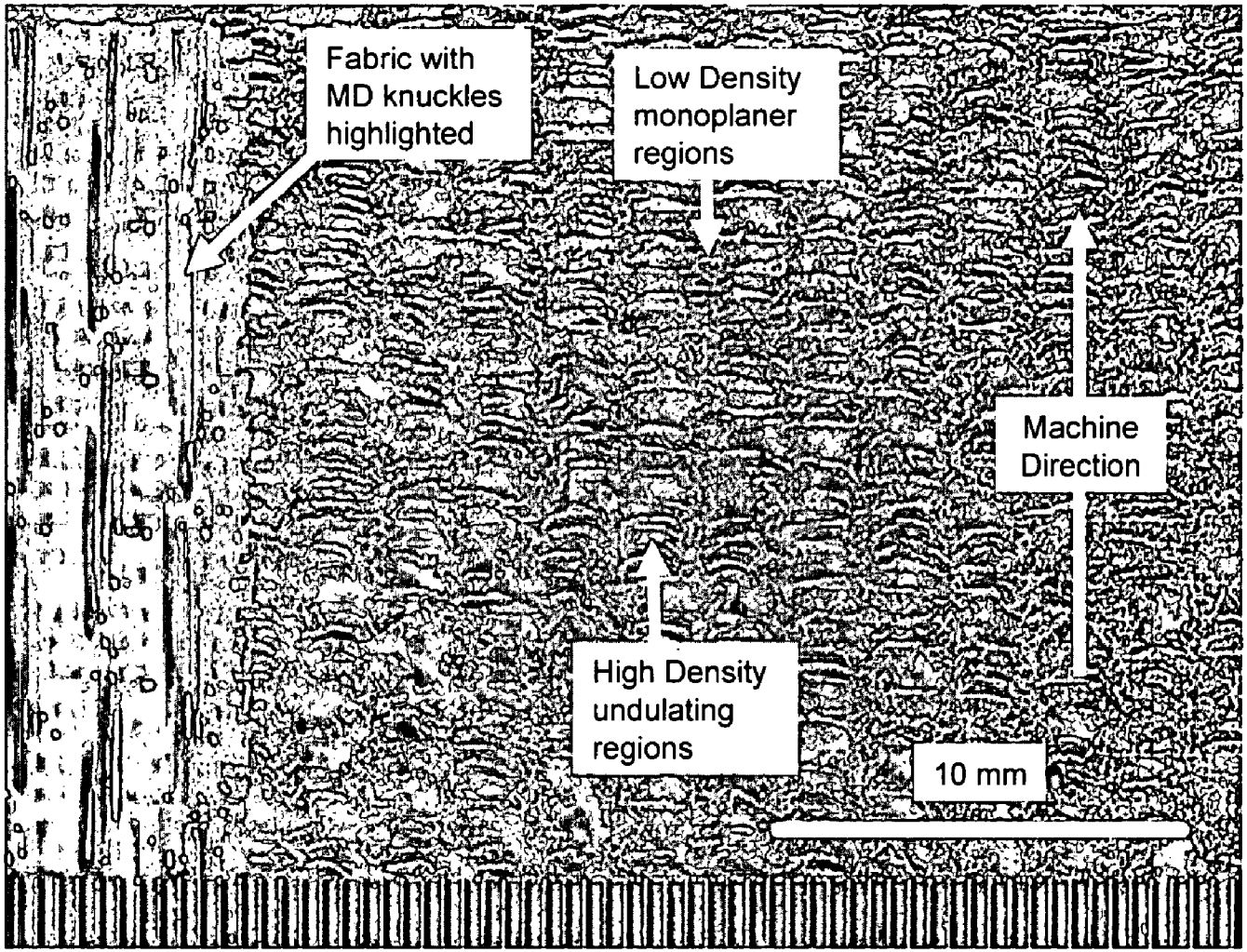
FIG. 3 is a magnified plan view photograph of the dryer-contacting side of a tissue sheet in accordance with this invention, shown side-by-side with the corresponding texturizing fabric used in the method of forming the sheet, showing the continuous machine direction ridges and the valleys containing mini-ridges as described above.

FIG. 3 is a magnified plan view photograph of the dryer-contacting side of a tissue sheet in accordance with this invention side-by-side with the corresponding texturizing fabric used in the method of forming the sheet, showing the continuous machine direction macro-ridges and the valleys containing mini-ridges as described above. (For photographs in the various figures, lighting was provided from the top and side, so that the depressed areas in the fabric are dark and the raised areas are light. For photos including a ruler, the space between each of the vertical lines in the scale at the bottom of the photograph represents 0.5 millimeter.)

Figure 4:
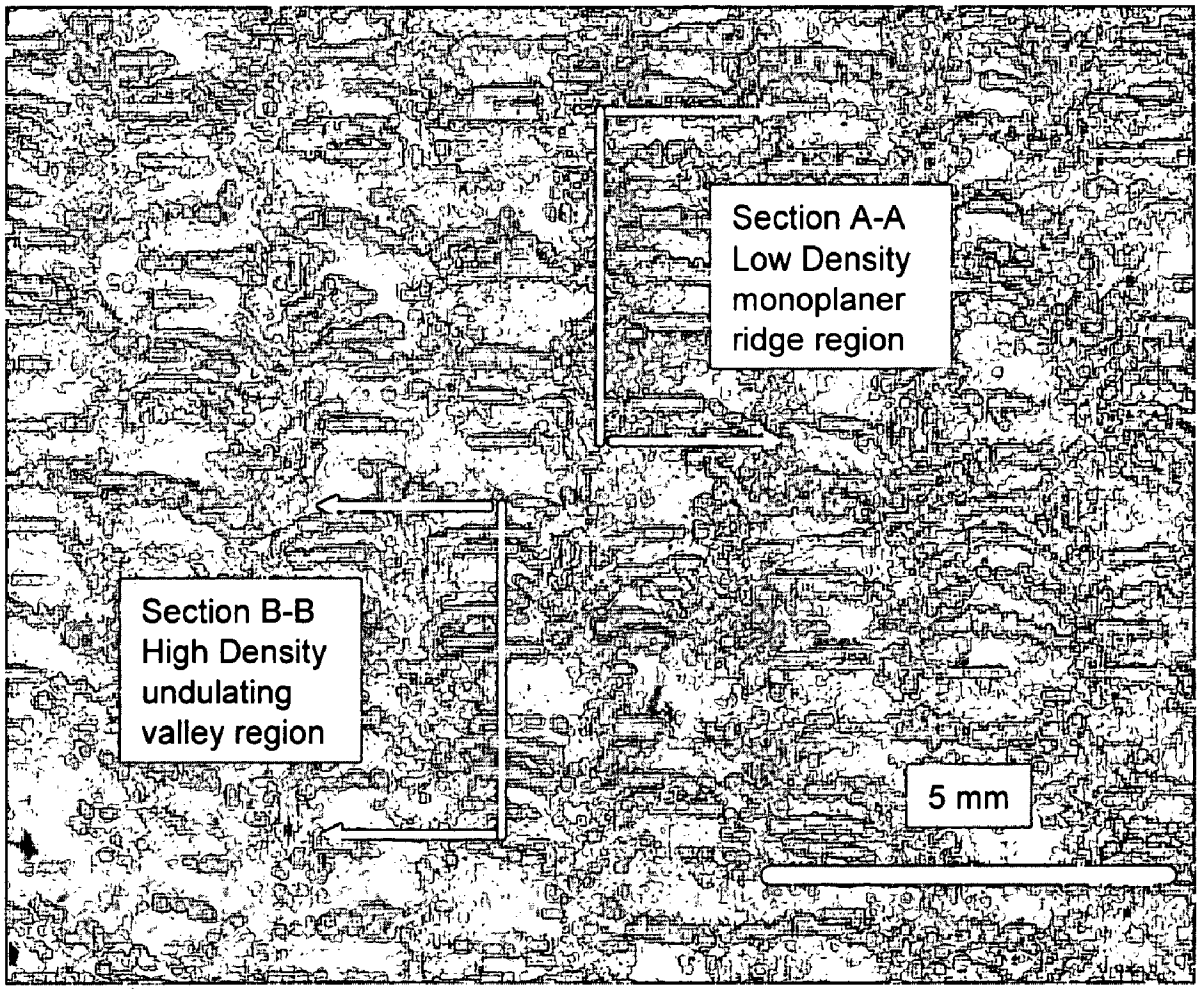
FIG. 4 is a magnified plan view of the tissue sheet of FIG. 3.

FIG. 4 is a magnified plan view of the tissue sheet of FIG. 3.

Figure 5A:
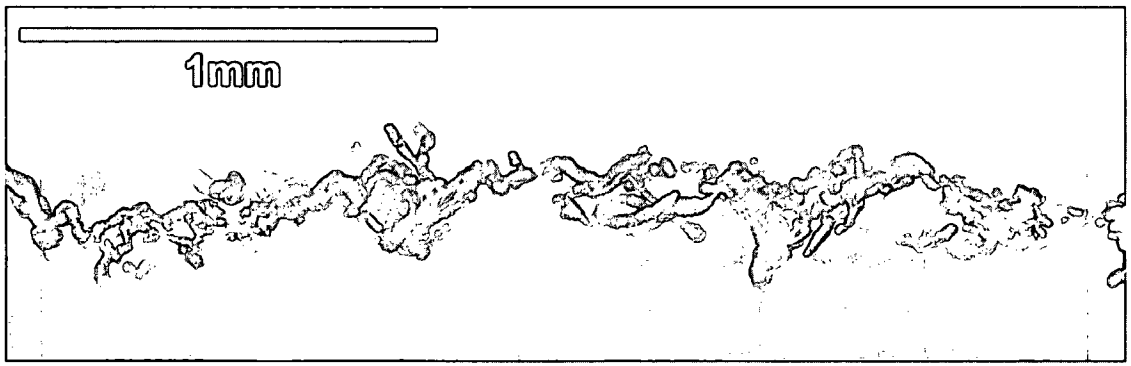
FIGS. 5A and 5B are magnified cross-sectional photographs taken along line A-A of FIG. 4, illustrating the substantially mono-planar low density characteristics of the machine direction ridge regions of the tissue sheets of this invention.
Figure 5B:
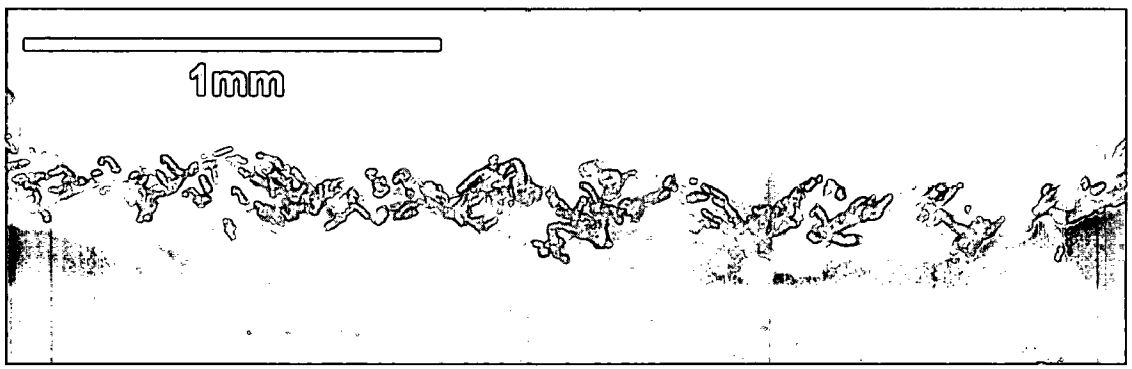

FIGS. 5A and 5B are magnified cross-sectional photographs taken along segments of line A-A of the tissue of FIG. 4, illustrating the substantially mono-planar low density characteristics of the machine direction macro-ridge regions of the tissue sheets of this invention. The thickness (the shortest distance from one side of the macro-ridge structure to the opposite side of the structure) of the macro-ridge segments shown ranges from about 75 to about 150 microns. The no-load caliper, which is an overall thickness between imaginary planes resting on each side of the structure in question and which takes into account any undulations, is about 200 microns. For purposes herein, "substantially mono-planar" macro-ridges can be numerically characterized as having a ratio of the no-load caliper to the average thickness of about 2 or less. For purposes of measuring the average thickness, at least 10 random thickness measurements should be taken along a given line for each tissue sheet being measured in order to obtain a representative value.

Figure 6A:
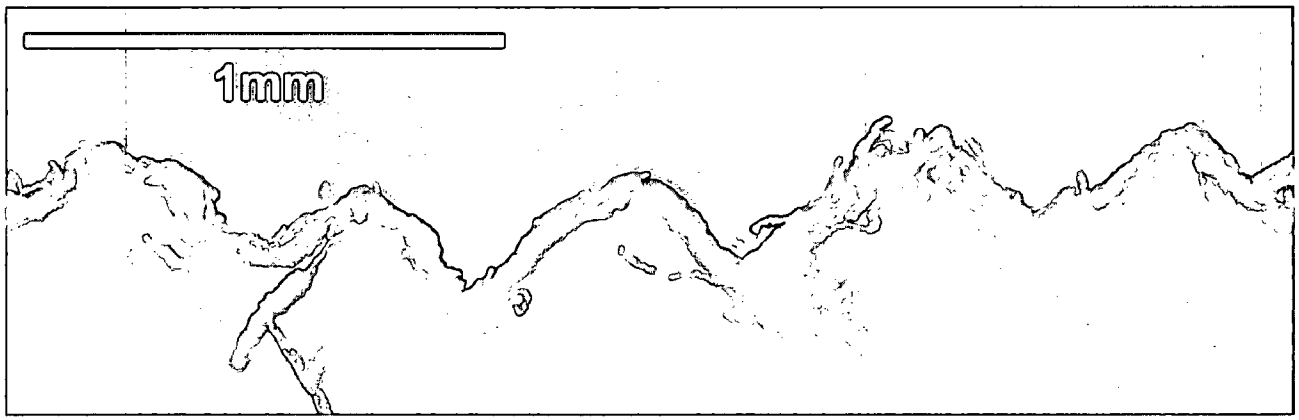
FIGS. 6A and 6B are magnified cross-sectional photographs taken along line B-B of FIG. 4, illustrating the undulations and the relatively high density of the machine direction ridges of the tissue sheets of this invention.
Figure 6B:
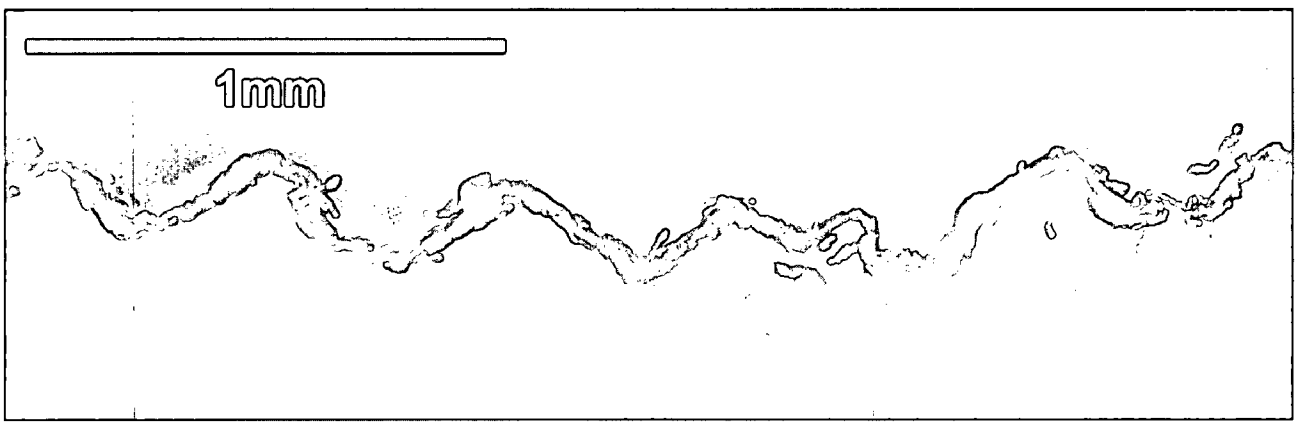

FIGS. 6A and 6B are magnified cross-sectional photographs taken along segments line B-B of FIG. 4, illustrating the undulations of the mini-ridges and the relatively high density of the mini-ridges of the tissue sheets of this invention. The thickness of the mini-ridge segments shown ranges from about 45 to about 60 microns. The overall no-load sheet caliper is about 300 microns.

Figure 7:
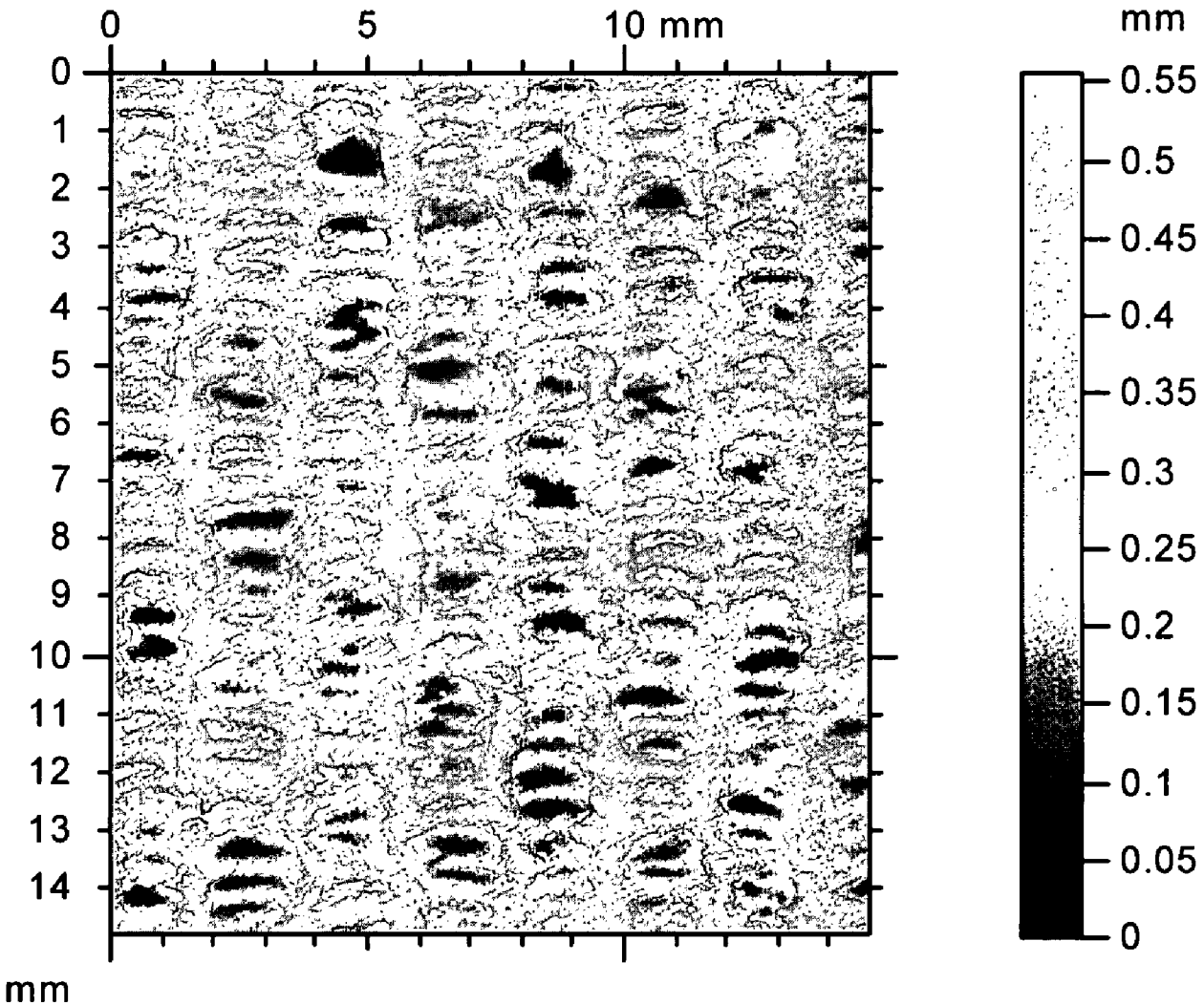
FIG. 7 is a surface profilometry image of the dryer side of a tissue sheet of this invention, illustrating the machine direction ridges and valleys, including the cross-machine direction min-ridges within the valley regions.

FIG. 7 is a gray scale surface profilometry image of the dryer side of a tissue sheet of this invention, illustrating the relative heights of the machine direction macro-ridges and valley regions in between, including the mini-ridges within the valley regions running in the cross-machine direction of the sheet.

Figure 8:
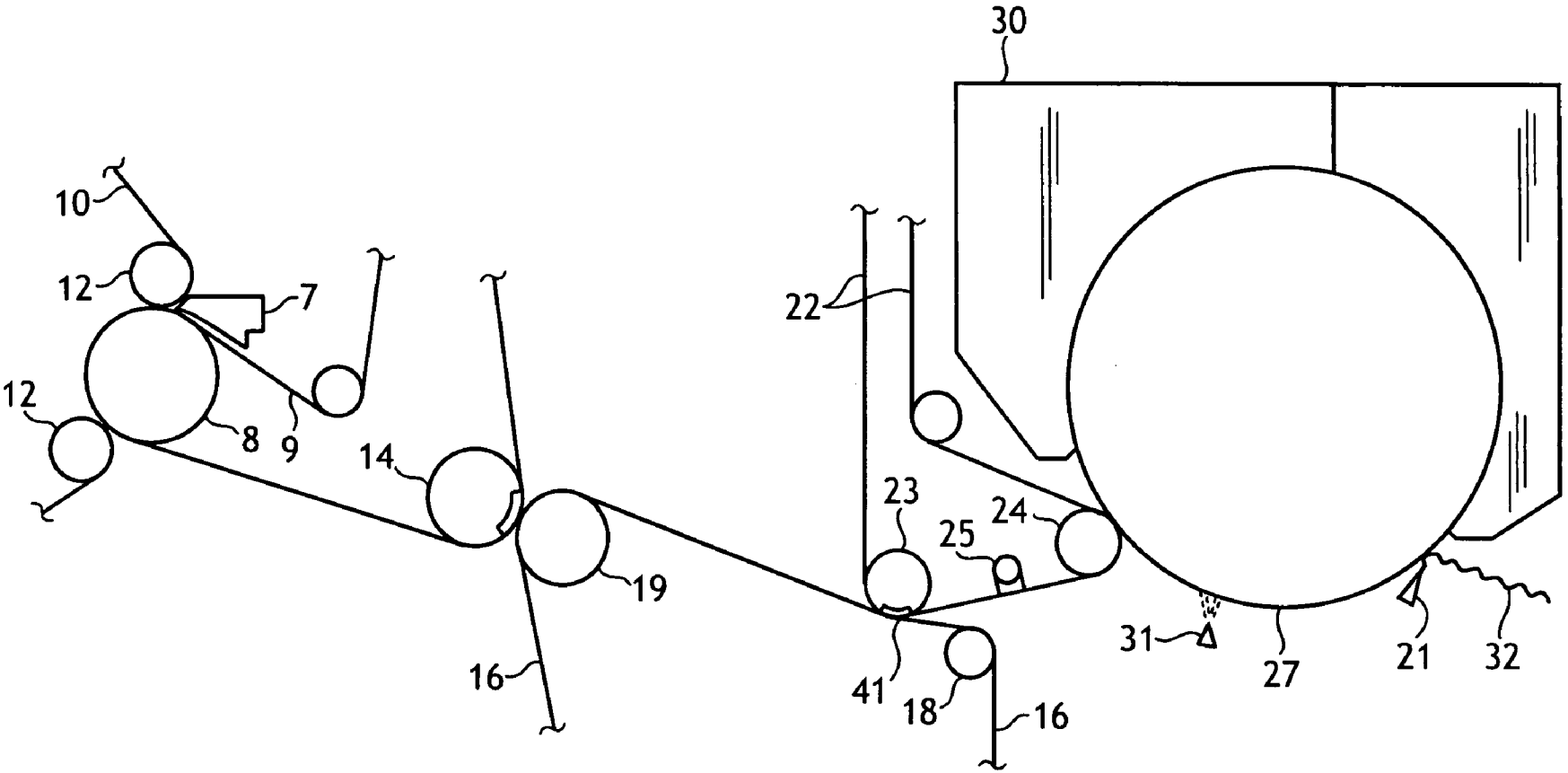
FIG. 8 is a schematic illustration of a wet-pressed tissue making process suitable for producing the tissue sheets of this invention.

FIG. 8 is a schematic illustration of a process useful for producing tissue sheets in accordance with this invention. In general, the method of making the tissue sheets of this invention comprises: (a) forming a wet tissue web having a basis weight of about 40 grams or less per square meter by depositing an aqueous suspension of papermaking fibers onto a forming fabric; (b) carrying the wet tissue web to a dewatering pressure nip while supported on a papermaking felt; (c) compressing the wet tissue web between the papermaking felt and a particle belt, whereby the wet tissue web is dewatered to a consistency of about 30 percent or greater and transferred to the surface of the particle belt; (d) transferring the dewatered web from the particle belt to a texturizing fabric, with the aid of vacuum, to mold the dewatered web to the surface contour of the fabric; (e) pressing the web against the surface of a Yankee dryer while supported by a texturizing fabric and transferring the web to the surface of the Yankee dryer; and (f) drying and creping the web to produce a creped tissue sheet.

Shown is a conventional crescent former, although any standard wet former can be used. More specifically, a headbox 7 deposits an aqueous suspension of papermaking fibers between a forming fabric 10 and a felt 9 as they partially wrap forming roll 8. The forming fabric is guided by guide rolls 12. As used herein, a "felt" is an absorbent papermaking fabric designed to absorb water and remove it from a tissue web. Papermaking felts of various designs are well known in the art.

The newly-formed web is carried by the felt to the dewatering pressure nip formed between suction roll 14, particle belt 16 and press roll 19. In the pressure nip, the tissue web is dewatered to a consistency of from about 30 percent or greater, more specifically about 40 percent or greater, more specifically from about 40 to about 50 percent, and still more specifically from about 45 to about 50 percent as it is compressed between the felt and the impermeable particle belt 16. As used herein and well understood in the art, "consistency" refers to the bone dry weight percent of the web based on fiber. The level of compression applied to the wet web to accomplish dewatering can advantageously be higher when producing light weight tissue webs in accordance with this invention.

As used herein, the "particle belt" is a water impermeable, or substantially water impermeable, transfer belt having many small holes and bumps in the otherwise smooth surface, the holes being formed from dislodged particles or gas bubbles previously embedded in the belt material when the belt is made. The size and distribution of the holes can be varied, but it is believed that the steep sidewall angles and size of these small holes prevents complete wetting of the belt surface because liquid water cannot enter them (similar physics to the Lotus leaf). The presence of the holes also brings entrained air in between the surface of the belt and the wet web. The presence of air or vapor aids in the break-up of the water film between the web and the surface of the belt and thereby reduces the level of adhesion between the web and the belt surface. In addition, a particle belt is not susceptible to the wear problems associated with a grooved belt because new holes are created as particles are uncovered and shed as the old holes are worn away. Examples of such particle belts are described in U.S. Pat. No. 5,298,124 issued Mar. 29, 1994 to Eklund et al. and entitled "Transfer Belt in a Press Nip Closed Draw Transfer", which is hereby incorporated by reference.

Upon exiting the press nip, the sheet stays with the impermeable particle belt and subsequently transferred to a texturizing fabric 22 with the aid of a vacuum roll 23 containing a vacuum slot 41. Press nip tension can be adjusted by the position of roll 18. An optional molding box 25 can be used to provide additional molding of the web to the texturizing fabric.

As used herein, a "texturizing fabric" is a three-dimensional papermaking fabric, particularly a woven papermaking fabric, which has a topography that can form the ridges and valleys in the tissue sheet as described above when the dewatered sheet is molded to conform to its surface. More particularly, a texturizing fabric is a woven papermaking fabric having a textured sheet contacting surface with substantially continuous machine-direction ripples separated by valleys, the ripples being formed of multiple warp strands grouped together and supported by multiple shute strands of one or more diameters; wherein the width of ripples is from about 1 to about 5 millimeters, more specifically from about 1.3 to about 3 millimeters, and still more specifically from about 1.9 to about 2.4 millimeters. The frequency of occurrence of the ripples in the cross-machine direction of the fabric is from about 0.5 to about 8 per centimeter, more specifically from about 3.2 to about 7.9, still more specifically from about 4.2 to about 5.3 per centimeter. The rippled channel depth, which is the z-directional distance between the top plane of the fabric and the lowest visible fabric knuckle that the tissue web may contact, can be from about 0.2 to about 1.6 millimeters, more specifically from about 0.7 to about 1.1 millimeters, and still more specifically from about 0.8 to about 1 millimeter. For purposes herein, a "knuckle" is a structure formed by overlapping warp and shute strands. Those skilled in the papermaking fabric arts will appreciate that variations from the illustrated fabrics can be used achieve the desired topography and web fiber support.

The level of vacuum used to effect the transfer of the tissue web from the particle belt to the texturizing fabric will depend upon the nature of the texturizing fabric. The vacuum at the pick-up (vacuum transfer roll) plays a much more important role for transferring light weight tissue webs from the transfer belt to the texturizing fabric than it does for heavier paper grades. Because the wet web tensile strength is so low, the transfer must be complete before the belt and fabric separate—otherwise the web will be damaged. On the other hand, for heavier weight paper webs there is sufficient wet strength to accomplish the transfer, even over a short micro-draw, with modest vacuum (20 kPa). For light weight tissue webs, the applied vacuum needs to be much stronger in order to cause the vapor beneath the tissue to expand rapidly and push the web away from the belt and transfer the web to the fabric prior to fabric separation. On the other hand, the vacuum cannot be so strong as to cause pinholes in the sheet after transfer.

The transfer of the web to the texturizing fabric can include a "rush" transfer or a "draw" transfer. Depending upon the nature of the texturizing fabric, rush transfer can aid in creating higher sheet caliper. When used, the level of rush transfer can be about 5 percent or less.

While supported by the texturizing fabric, the web is transferred to the surface of a Yankee dryer 27 via press roll 24, after which the web is dried and creped with a doctor blade 21. Also shown is the Yankee dryer hood 30 and the creping adhesive spray applicator 31. The resulting creped web 32 is thereafter rolled into a parent roll (not shown) and converted as desired to the final product form and packaged.

In carrying out the foregoing method on a continuous commercial basis, fabric cleaning can be particularly advantageous, particularly using a method which leaves a minimal amount of water on the fabric (about 3 gsm or less). Suitable fabric cleaning methods include air jets, thermal cleaning, coated fabrics which clean easier, and high pressure water jets.

Figure 9:
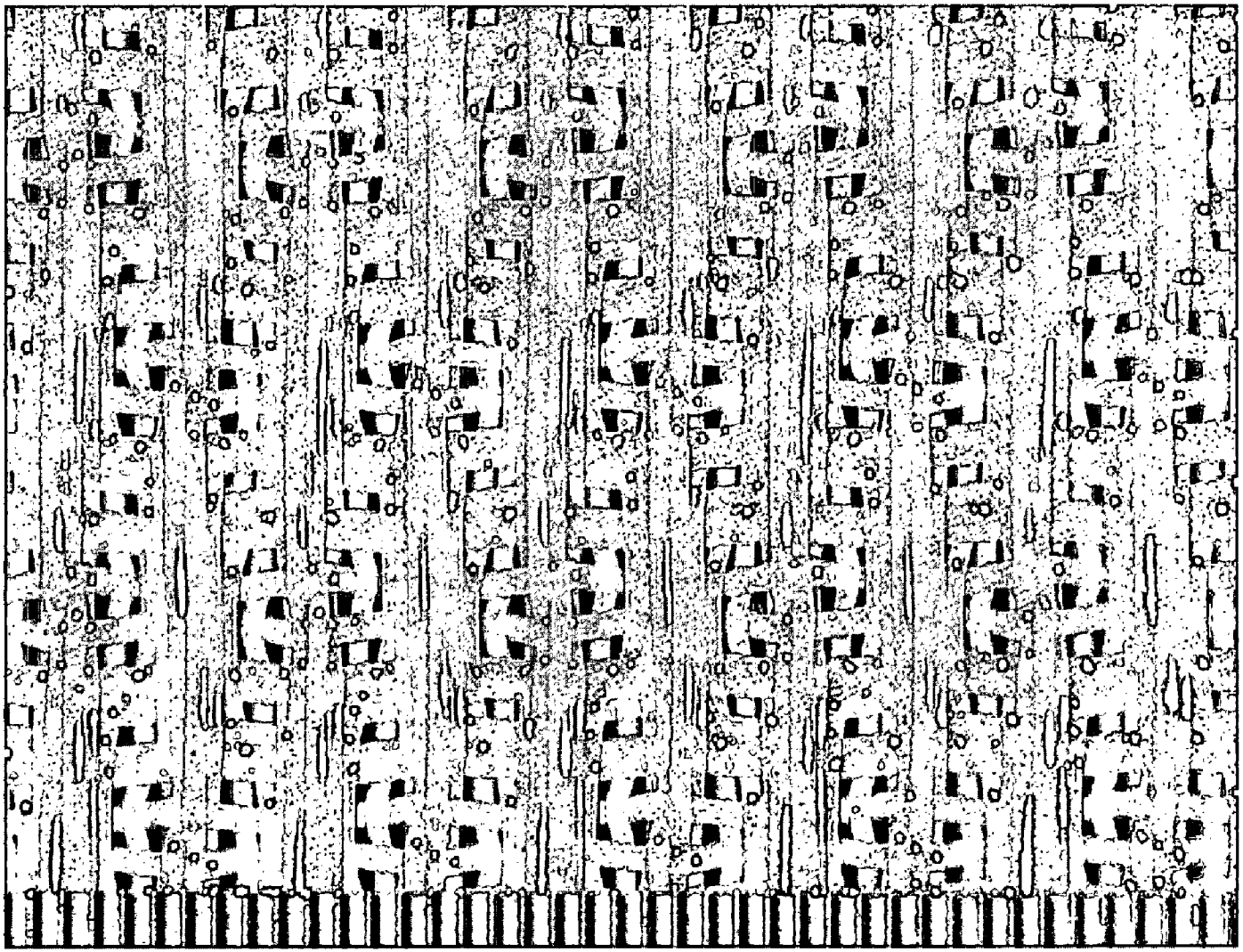
FIGS. 9-13 are magnified photographs of texturizing fabrics useful for producing the tissue sheets of this invention, illustrating the spaced apart continuous or substantially continuous machine direction structures that create the machine direction ridges in the tissue sheets of this invention.

FIG. 9 is a plan view photograph of the sheet contacting side of a papermaking fabric useful as a texturizing fabric for producing the tissue sheets of this invention, illustrating the spaced apart continuous or substantially continuous machine direction structures that create the machine direction ridges in the tissue sheets of this invention. FIG. 9 shows the weave pattern and specific locations of three different diameter shutes used to produce a deep, rippled structure in which the fabric ridges are higher and wider than individual warp strands. The fabric is a single layer structure in that all warps and shutes participate in both the sheet-contacting side of the fabric as well as the machine side of the fabric. The rippled channel depth is 0.967 mm or 293% of the combined warp and weighted-average shute diameters. For the purposes of this invention, the fabric can be sanded. For such topographical fabrics, contact areas typically range between 15 and 30% so sanding will improve the drying efficiency by increasing the amount of tissue firmly pressed against the dryer.

Figure 10:
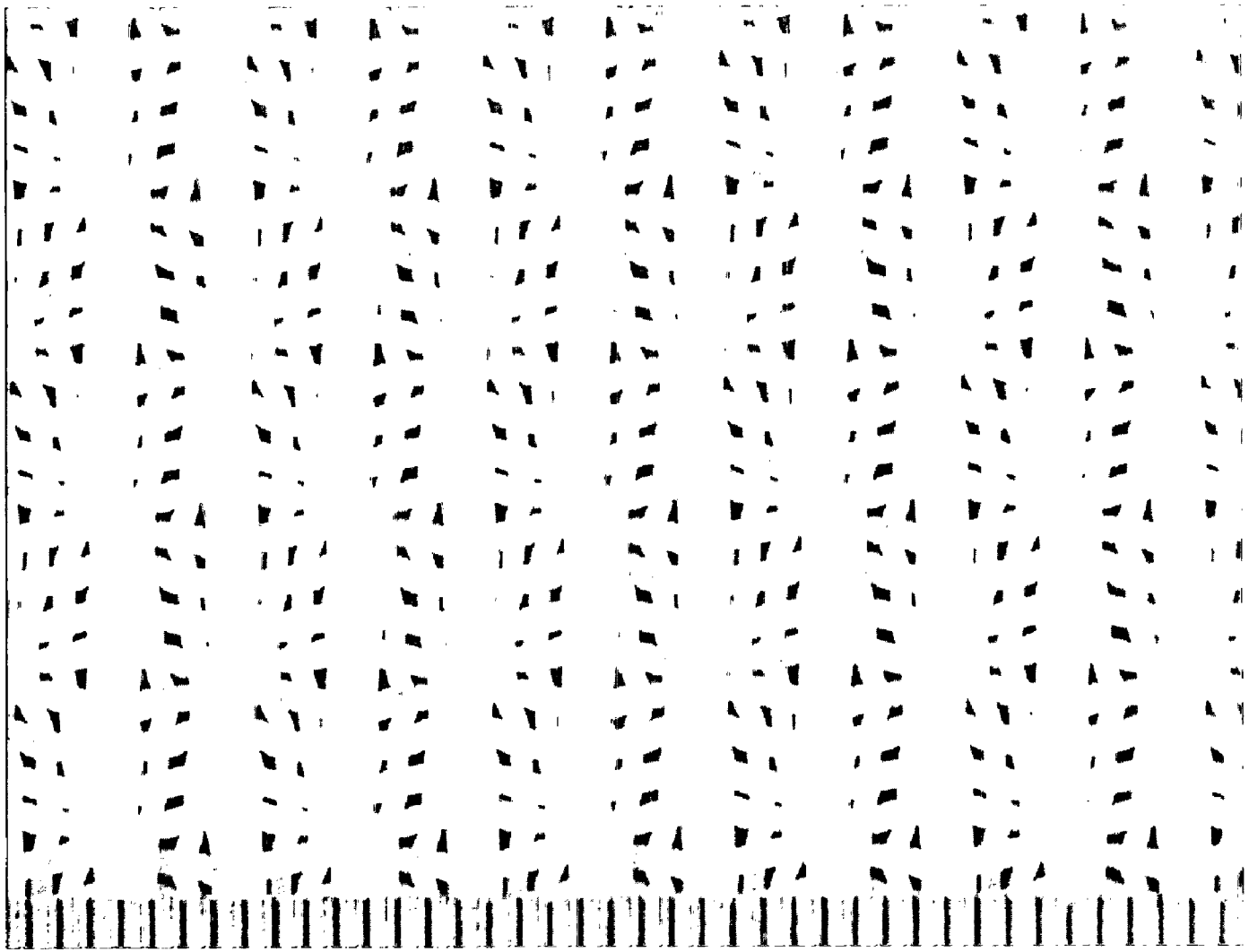

FIG. 10 is a plan view photograph of the sheet contacting side of another papermaking fabric useful as a texturizing fabric for producing the tissue sheets of this invention. Only one shute diameter is present in the structure and the resulting rippled channel depth is 0.72 mm, or 218% of the combined warp and weighted-average shute diameters.

Figure 11:
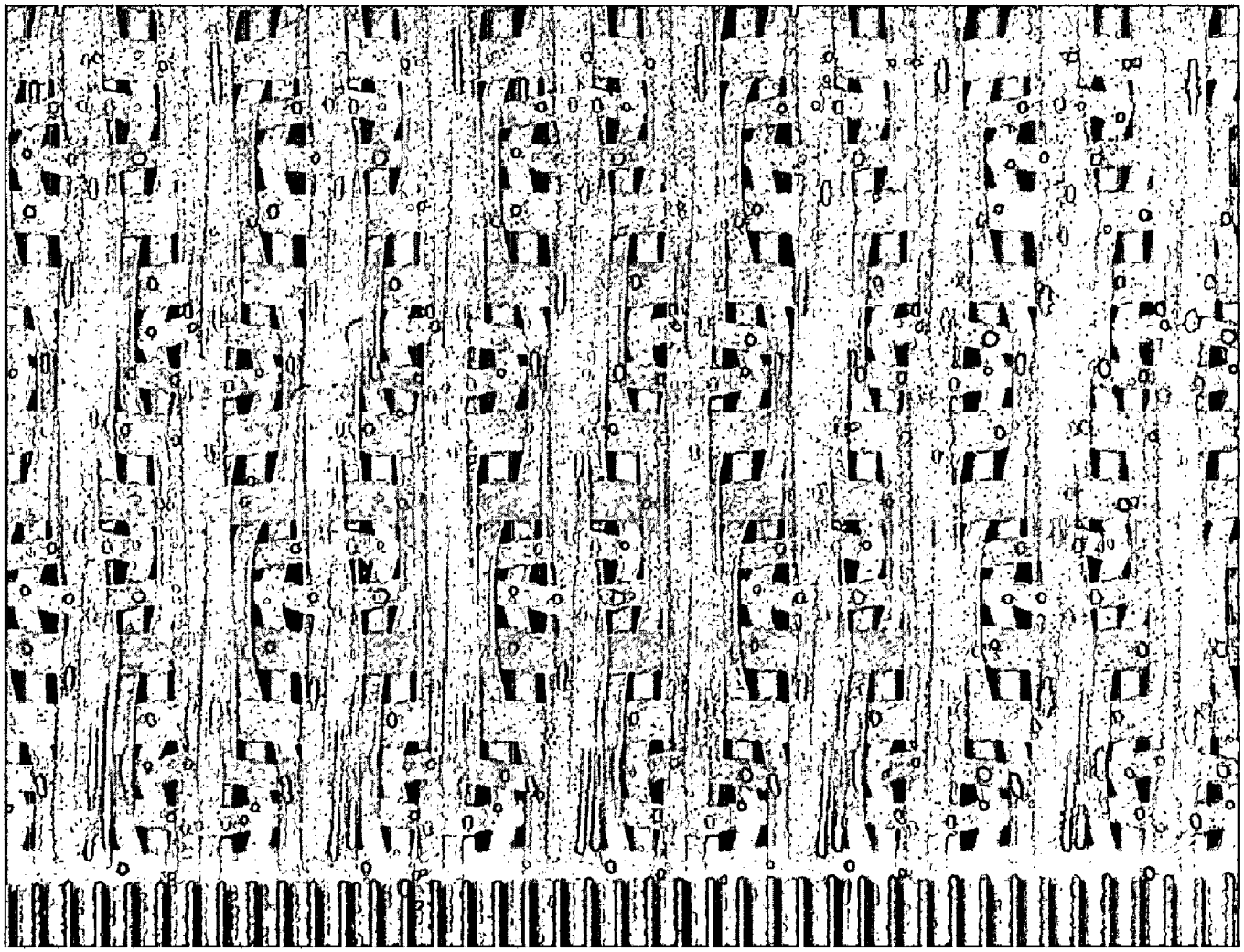

FIG. 11 is a plan view photograph of the sheet contacting side of another papermaking fabric useful as a texturizing fabric for producing the tissue sheets of this invention. Two different shute diameters are present in the structure and the fabric ripple which creates the tissue macro-ridge is parallel to the machine direction.

Figure 12:
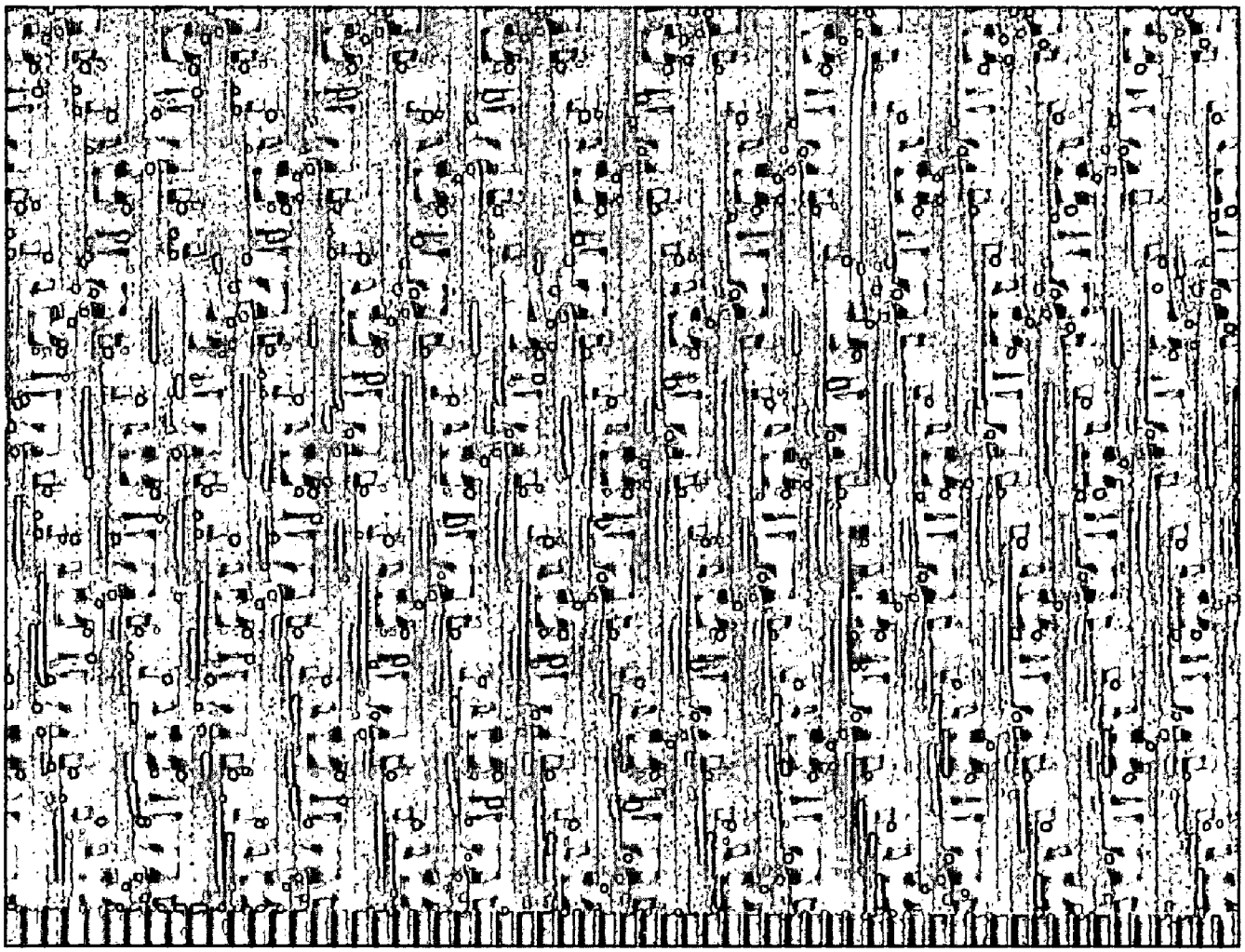

FIG. 12 is a plan view photograph of the tissue contacting side of another suitable texturizing fabric, illustrating an angled rippled structure. The fabric ripples are substantially continuous, not discrete, and formed of multiple warp strands grouped together and supported by multiple shute strands of three different diameters. Similar structures can be constructed using shute strands of one or more diameters. The warp strands are substantially oriented in the machine direction and each individual warp strand participates in both the structure of ripples and the structure of valleys. The fabric ridges and valleys are oriented at an angle of about 5 degrees relative to the true machine direction of the sheet. The angle is a function of both weave structure and pick count. When used as an impression or through-air-drying fabric for creped tissue making processes, the angle of the resulting tissue ridges and valleys may be foreshortened due to the speed differential between the Yankee dryer and the reel. The foreshortened angle can be calculated as described in U.S. Pat. No. 5,832,962 entitled "System for Making Absorbent Paper Products", granted Nov. 10, 1998, which is herein incorporated by reference. By way of example, for a creping process in which the web is wound up at a speed 20% slower than the Yankee speed, the resultant, foreshortened angle of the Yankee-side tissue ridge would be 12 degrees for the fabric shown in FIG. 12.

Figure 13:
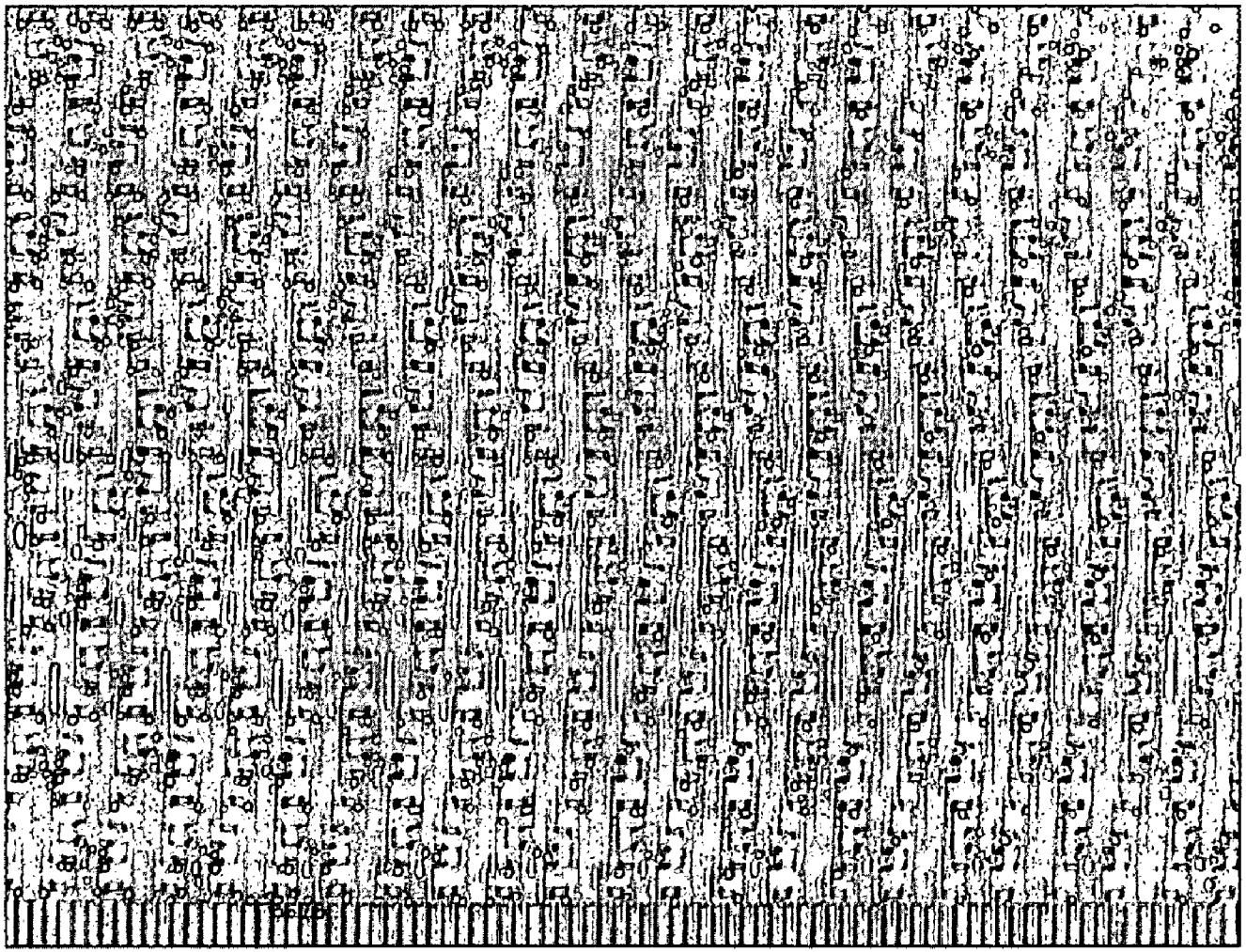

FIG. 13 is a plan view photograph of the tissue contacting side of another papermaking fabric useful as a texturizing fabric for producing the tissue sheets of this invention, illustrating the weave pattern and specific locations of the different diameter shutes used to produce the deep, wavy rippled structure. The fabric ripples are substantially continuous but aligned along a slight angle (up to 15 degrees) with respect to the machine direction. The ripples are higher and wider than individual warp strands and individual warp strands participate in both the fabric ripple and the fabric valley due to the warp strands being substantially oriented in the machine direction. The angle of the fabric ripples regularly reverse direction in terms of movement in the cross-machine direction, creating a wavy rippled appearance which can enhance tissue aesthetics or reduce the tendency for adjacent layers of tissue to nest along the rippled structure. For creped applications the wavy ripple also serves to alternate the locations along the Yankee dryer surface to which the tissue web is adhered. In the fabric shown, the ripple reverses direction after traversing approximately one-half of the cross-machine spacing between the ripples.

Figure 14:
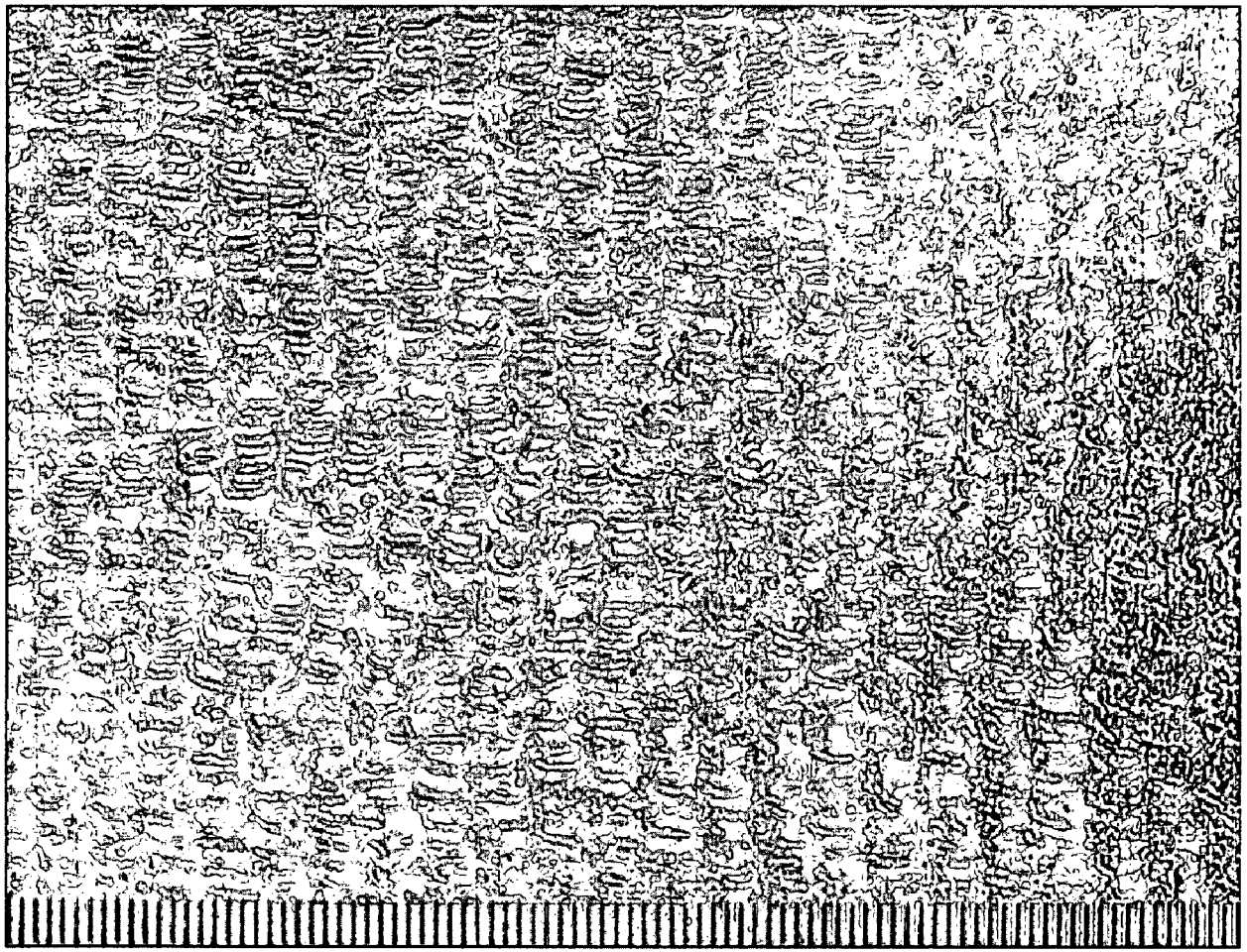
FIG. 14 is a magnified photograph of a tissue of this invention made using the texturizing fabric of FIG. 13.

FIG. 14 is a plan view magnified photograph of a tissue sheet of this invention having wavy macro-ridges running in the machine direction and which was made using the texturizing fabric of FIG. 13.

EXAMPLES

Example 1

Tissue sheets in accordance with this invention as illustrated in FIGS. 1-7 were made using the process as described above in connection with FIG. 8. In particular, a crescent former was used to make a lightweight paper sheet of 13.8 gsm. The furnish was a 30:70 blend of northern softwood and eucalyptus fibers. The paper machine speed at the Yankee dryer was 800 meters/minute. The wet tissue web was transferred to a felt and partially dewatered with vacuum to a consistency of about 25% solids. The web was then compressively dewatered with an extended nip press at a load of 600 kNt/m, with a peak pressure of 6 MPa. The felt and web were pressed against a smooth belt similar to an Albany LA particle transfer belt with a roughness of about 3 micrometers. Upon exiting the press, the web was adhered to the transfer belt. The belt and web traveled around the press roll and were then brought into contact with the texturizing fabric illustrated in FIG. 9, which had been sanded to improve subsequent contact area with the surface of the Yankee dryer. The estimated contact area was about 30% under a 1.7 MPa load. The distance from the press to the vacuum roll was about 4 meters. The texturizing fabric was in contact with the transfer belt and tissue web for a distance of about 25 mm after it came into contact with a vacuum roll. Just prior to separation of the fabric and the transfer belt, a high vacuum level about 30 kPa was supplied from inside a vacuum roll, causing the web to transfer from the transfer belt to the texturizing fabric. There was a 5% rush transfer at the time of the transfer of the web to the fabric, but this speed differential is optional. The web and fabric traveled together to a pressure roll at the Yankee dryer, where the molded web was pressed to the surface of the Yankee dryer. The web adhered to the Yankee with the aid of adhesives sprayed onto the Yankee surface prior to the pressure roll. The web was dried and creped to a moisture content or 1-2% and wound up at a speed 20% slower than the Yankee speed. The physical properties of the resulting tissue sheet were as follows:

| | | |
|---|---|---|
| Basis weight (bone dry) | gsm | 17.3 |
| Caliper | μm | 300 |
| Bulk | cm3/g | 17.3 |
| Stretch (MD) | % | 39.6 |
| Stretch (CD) | % | 9.6 |
| Tensile (MD) | N/m | 125 |
| Tensile (CD) | N/m | 54 |

The tissue sheet was converted into 2-ply bath tissue with calendaring and exhibited good softness.

Example 2

A tissue sheet was made generally as described in Example 1, except that the paper machine speed at the Yankee dryer was 1000 m/min and the basis weight was targeted for a 1-ply finished product. The dryer basis weight was 22.0 gsm, and the vacuum level supplied to the inside of the vacuum roll was 40 kPa. The texturizing fabric was of a style similar to that in FIG. 9.

The physical properties of the resulting tissue sheet were as follows:

| | | |
|---|---|---|
| Basis weight (bone dry) | gsm | 27.6 |
| Caliper | μm | 316 |
| Bulk | cm3/g | 11.4 |
| Stretch (MD) | % | 30.0 |
| Stretch (CD) | % | 5.6 |
| Tensile (MD) | N/m | 193 |
| Tensile (CD) | N/m | 90 |

Example 3

A tissue sheet was made generally as described in Example 1, except that the paper machine speed at the Yankee dryer was 1000 m/min and the texturizing fabric was of a style similar to FIG. 13. The dryer basis weight was 13.7 gsm. There was a 3% rush transfer at the time of the transfer of the web to the fabric. The resulting tissue was similar to that shown in FIG. 14.

The physical properties of the resulting tissue sheet were as follows:

| | | |
|---|---|---|
| Basis weight (bone dry) | gsm | 17.1 |
| Caliper | μm | 293 |
| Bulk | cm3/g | 14.2 |
| Stretch (MD) | % | 28.8 |
| Stretch (CD) | % | 6.9 |
| Tensile (MD) | N/m | 124 |
| Tensile (CD) | N/m | 41 |

Example 4

A tissue sheet was made generally as described in Example 1, except that the paper machine speed at the Yankee dryer was 600 m/min. The dryer basis weight was 14.5 gsm. There was a 5% rush transfer at the time of the transfer of the web to the fabric.

The physical properties of the resulting tissue sheet were as follows:

| | | |
|---|---|---|
| Basis weight (bone dry) | gsm | 18.1 |
| Caliper | μm | 311 |
| Bulk | cm3/g | 17.2 |
| Stretch (MD) | % | 35.3 |
| Stretch (CD) | % | 11.2 |
| Tensile (MD) | N/m | 75 |
| Tensile (CD) | N/m | 39 |

The basesheet was then converted into a 2-ply roll of bath tissue by plying the basesheet with another roll of similar properties, with the fabric facing side of the basesheets facing each other in the final product. The 2-ply product was calendered with steel rollers spaced apart by 635 micron (0.025 inch) and wound onto a 43 mm diameter core. This product was preferred over existing commercial bath tissue product in consumer testing. The resulting physical properties of the finished product were as follows:

| | | |
|---|---|---|
| Basis weight (bone dry) | gsm | 31.2 |
| Caliper | μm | 344 |
| Bulk | cm3/g | 11.0 |
| Stretch (MD) | % | 16.6 |
| Stretch (CD) | % | 6.8 |
| Tensile (MD) | N/m | 156 |
| Tensile (CD) | N/m | 65 |
| Roll diameter | mm | 123 |
| Roll Bulk | cm3/g | 10.2 |

It will be appreciated that the foregoing examples, given for purposes of illustration, are not to be construed as limiting the scope of the invention, which is defined by the following claims and all equivalents thereto.

We claim:

1. A creped, wet-pressed tissue sheet of papermaking fibers having a machine direction and a cross-machine direction, said tissue sheet having continuous mono-planar macro-ridges running in the machine direction of the sheet, said macro-ridges being separated by valleys of undulating mini-ridges, said mini-ridges having crests running in the cross-machine direction of the sheet, wherein the macro-ridges have a lower fiber density than the fiber density of the valleys.

2. The tissue sheet of claim 1 wherein the valleys of undulating mini-ridges are continuous.

3. The tissue sheet of claim 1 wherein the macro-ridges are parallel to the machine direction of the sheet.

4. The tissue sheet of claim 1 wherein the macro-ridges are oriented at an angle of from 0 to about ±15 degrees relative to the machine direction of the sheet.

5. The tissue sheet of claim 1 wherein the macro-ridges are oriented at an angle of from about 5 to about 15 degrees or from about −5 to about −15 degrees relative to the machine direction of the sheet.

6. The tissue sheet of claim 1 wherein the macro-ridges are oriented at an angle of from about 5 to about 10 degrees or from about −5 to about −10 degrees relative to the machine direction of the sheet.

7. The tissue sheet of claim 1 wherein the ratio of the average thickness of the macro-ridges to the thickness of the mini-ridges is from about 1.5 to about 6.

8. The tissue sheet of claim 1 wherein the ratio of the average thickness of the macro-ridges to the thickness of the mini-ridges is from about 1.5 to about 5.

9. The tissue sheet of claim 1 wherein the ratio of the average thickness of the macro-ridges to the thickness of the mini-ridges is from about 1.5 to about 4.

10. The tissue sheet of claim 1 wherein the ratio of the average thickness of the macro-ridges to the thickness of the mini-ridges is from about 1.5 to about 3.

11. The tissue sheet of claim 1 wherein the ratio of the average thickness of the macro-ridges to the thickness of the mini-ridges is from about 2 to about 3.

12. The tissue sheet of claim 1 wherein the width of the macro-ridges is less than the width of the valleys.

13. The tissue sheet of claim 1 wherein the width of the macro-ridges is from about 0.5 to about 1.5 millimeters.

14. The tissue sheet of claim 1 wherein the spacing of the macro-ridges, as measured peak-to-peak, is from about 0.5 to about 4 millimeters.

15. The tissue sheet of claim 1 wherein the width of the valleys is from about 0.5 to about 2.5 millimeters.

16. The tissue sheet of claim 1 wherein the machine direction spacing of the mini-ridges, as measured peak-to-peak, can be from about 0.2 to about 1 millimeter.

17. The tissue sheet of claim 1 wherein the height of the mini-ridges is from about 0.05 to about 0.5 millimeter.

18. The tissue sheet of claim 1 wherein the basis weight is from about 10 to about 40 grams per square meter.

19. The tissue sheet of claim 1 wherein the bulk is from about 10 to about 20 cubic centimeters per gram.

* * * * *